US009302804B2

(12) United States Patent
Sugimoto et al.

(10) Patent No.: US 9,302,804 B2
(45) Date of Patent: Apr. 5, 2016

(54) LABEL ATTACHMENT DEVICE

(75) Inventors: Hiroshi Sugimoto, Osakasayama (JP); Satoshi Nii, Kobe (JP)

(73) Assignee: FUJI SEAL INTERNATIONAL, INC., Osaka (JP)

( * ) Notice: Subject to any disclaimer, the term of this patent is extended or adjusted under 35 U.S.C. 154(b) by 164 days.

(21) Appl. No.: 14/342,008

(22) PCT Filed: Sep. 6, 2011

(86) PCT No.: PCT/JP2011/070250

§ 371 (c)(1),
(2), (4) Date: Feb. 28, 2014

(87) PCT Pub. No.: WO2013/035158

PCT Pub. Date: Mar. 14, 2013

(65) Prior Publication Data

US 2014/0209246 A1 Jul. 31, 2014

(51) Int. Cl.

| | |
|---|---|
| ***B65C 9/00*** | (2006.01) |
| ***B65C 9/26*** | (2006.01) |
| ***B65C 3/08*** | (2006.01) |
| ***B65C 3/06*** | (2006.01) |

(52) U.S. Cl.

CPC . *B65C 9/26* (2013.01); *B65C 3/065* (2013.01); *B65C 3/08* (2013.01)

(58) Field of Classification Search

CPC ..... B29C 63/18; B65C 3/065; B65C 3/08; B65C 9/26

USPC ..... 156/475; 53/399, 582, 585

See application file for complete search history.

(56) References Cited

U.S. PATENT DOCUMENTS 4,188,249 A * 2/1980 Fujio ..... B29C 63/18 156/165
2010/0163164 A1* 7/2010 Deonarine ..... B65C 9/0065 156/229

FOREIGN PATENT DOCUMENTS

| | | |
|---|---|---|
| JP | A-53-125183 | 11/1978 |
| JP | A-2000-43835 | 2/2000 |
| JP | A-2000-190934 | 7/2000 |
| JP | A-2002-284130 | 10/2002 |

OTHER PUBLICATIONS

International Search Report issued in International Application No. PCT/JP2011/070250 mailed Dec. 13, 2011.

* cited by examiner

*Primary Examiner* — George Koch
(74) *Attorney, Agent, or Firm* — Oliff PLC

(57) ABSTRACT

The present invention includes: a label opening unit, which preliminarily opens a tubular label folded in a sheet; a label expansion unit, which expands the preliminarily opened label; a bottle lifting unit having a mounting, on which the bottle is mounted and which can rise and fall; and a bottle pull-up unit, which lifts the bottle while holding with the bottle an upper end portion of the label attached to the bottle. After the bottle lifting unit has lifted the mounting on which the bottle is mounted, thereby inserting the bottle into the label expanded by the label expansion unit, the bottle pull-up unit pulls up the bottle, thereby removing expansion claws from the label and moving the bottle to above clamp members of the label opening unit.

4 Claims, 13 Drawing Sheets

LABEL ATTACHMENT DEVICE

This application is a national stage entry of PCT/JP2011/070250, filed on Sep. 6, 2011.

TECHNICAL FIELD

The invention relates to a label attachment device for attaching a tubular label such as a stretch label to an attachment target object such as a jar or a bottle.

BACKGROUND ART

For example, as a label attachment device that attaches a tubular stretch label to the outer peripheral surface of a main body portion of a bottle such as a PET bottle, which serves as a beverage container, there is a rotary label attachment device including a plurality of attachment heads. As shown in (a) of FIG. 14, each attachment head includes: a pair of openable and closable clamp members 71, which preliminarily open a tubular stretch label L supplied as folded in a sheet, and have suction portions at their extremities; a pair of openable and closable expansion claws 72, which expand the stretch label L opened by the clamp members 71, more widely than the outer diameter of a bottle B; and a mounting 73, which rises and falls with the bottle B mounted thereon.

In such a label attachment device, the tubular stretch label L is attached to the bottle B as follows. First, as shown in (a) of FIG. 14, the pair of clamp members 71 clamp the tubular stretch label L supplied as folded in a sheet. With both sides of the label L held by suction by clamping portions, as shown in (b) of FIG. 14, the clamp members 71 open to separate both sides of the stretch label L from each other, thereby opening the stretch label L into a tubular shape.

Next, as shown in (c) to (e) of FIG. 14, the expansion claws 72 in a closed state rise while gradually opening, thereby inserting the expansion claws 72 into the stretch label L that is in an open state and held by suction by the clamp members 71. Then, as shown in (f) of FIG. 14, the expansion claws 72 further open, thereby expanding the label L.

Then, as shown in (g) of FIG. 14, the expansion claws 72 expanding the stretch label L fall to the label attachment level, and meanwhile, as shown in (g) to (j) of FIG. 14, the mounting 73 on which the bottle B is mounted starts rising, thereby inserting the bottle B into the stretch label L expanded by the expansion claws 72 at the label attachment level.

If the stretch label L has thus been inserted into the bottle B (see (j) of FIG. 15), then as shown in (k) and (l) of FIG. 15, the mounting 73 on which the bottle B is mounted further rises, thereby removing the expansion claws 72 from the stretch label L and completely attaching the stretch label L to the bottle B.

Then, as shown in (m) to (p) of FIG. 15, the mounting 73 on which the bottle B is mounted falls, thereby moving the bottle B to below the clamp members 71, whereby the process returns to an initial state shown in (a) of FIG. 15 ((a) of FIG. 14).

CITATION LIST

Patent Literature

[PTL 1] Japanese Laid-Open Patent Publication No. 2002-284130

SUMMARY OF THE INVENTION

Problems to be Solved by the Invention

In the label attachment device described above, however, after the bottle B has been inserted into the stretch label L expanded at the label attachment level, the bottle B is once lifted to remove the expansion claws 72 from the stretch label L, and then, the bottle B falls. Thus, while the bottle B moves to below the clamp members 71, the clamp members 71 cannot execute a series of processes from the reception of a new stretch label L to the preliminarily opening of the stretch label L.

Thus, such a label attachment device cannot secure a large assigned angle for executing a series of processing steps from the reception of a label to the preliminary opening of the label, and therefore is unfit for speeding up.

It is an objective of the invention to provide a label attachment device that can secure a sufficient assigned angle for executing a series of processing steps from the reception of a label to the preliminary opening of the label, and is suitable for speeding up.

Solution to the Problems

To achieve the above objective, the invention of claim 1 provides a label attachment device including: a label opening unit configured to preliminarily open a tubular label supplied as folded in a sheet; a label expansion unit having openable and closable expansion claws configured to expand the label preliminarily opened by the label opening unit; and a lifting unit configured to lift to a label attachment level a mounting on which an attachment target object is mounted, wherein the lifting unit lifts the mounting on which the attachment target object is mounted, thereby inserting the attachment target object into the tubular label expanded by the expansion claws, and the expansion claws are removed from the label, thereby attaching the label to the attachment target object that is moving along a predetermined movement path, the label attachment device further includes a pull-up unit configured to pull up the attachment target object to which the label is attached, while holding the attachment target object at a label portion, and after the attachment target object has been inserted into the label, the pull-up unit pulls up the attachment target object, thereby removing the expansion claws from the label and moving the attachment target object to above the label opening unit, so that, while a process after the label opening unit receives the label is executed, the attachment target object to which the label is attached is conveyed above the label opening unit.

Further, in the invention of claim 2, on the basis of the label attachment device according to the invention of claim 1, the pull-up unit pulls up the attachment target object, thereby, when the expansion claws are removed from the label, temporarily lifting the mounting on which the attachment target object is mounted, in conjunction with an operation of the pull-up unit pulling up the attachment target object.

Further, in the invention of claim 3, on the basis of the label attachment device according to the invention of claim 1, the pull-up unit pulls up the attachment target object, thereby, when the expansion claws are removed from the label, causing the expansion claws to once fall while temporarily lifting the mounting on which the attachment target object is mounted, in conjunction with an operation of the pull-up unit pulling up the attachment target object.

Further, the invention of claim 4 is a label attachment device including: a label opening unit configured to preliminarily open a tubular label supplied as folded in a sheet; a label expansion unit having openable and closable expansion claws configured to expand the label preliminarily opened by the label opening unit; and a lifting unit configured to lift to a label attachment level a mounting on which an attachment target object is mounted, wherein the lifting unit lifts the mounting on which the attachment target object is mounted, thereby inserting the attachment target object into the tubular label expanded by the expansion claws, and the expansion claws are removed from the label, thereby attaching the label to the attachment target object that is moving along a predetermined movement path, the label attachment device further includes a pull-up unit configured to pull up the attachment target object to which the label is attached, while holding the attachment target object at a label portion, and after the attachment target object has been inserted into the label, the expansion claws once fall with the pull-up unit holding the attachment target object at the label portion, thereby removing the expansion claws from the label, and then, the pull-up unit pulls up the attachment target object, thereby moving the attachment target object to above the label opening unit, so that, while a process after the label opening unit receives the label is executed, the attachment target object to which the label is attached is conveyed above the label opening unit.

Advantageous Effects of the Invention

As described above, the label attachment device according to the invention of claim 1 includes a pull-up unit configured to pull up the attachment target object to which the label is attached, while holding the attachment target object at a label portion, and after the attachment target object has been inserted into the label, the pull-up unit pulls up the attachment target object, thereby removing the expansion claws from the label and moving the attachment target object to above the label opening unit, so that, while a process after the label opening unit receives the label is executed, the attachment target object to which the label is attached is conveyed above the label opening unit. This makes it possible to secure a more sufficient assigned angle for executing a series of processing steps from the reception of a label to the preliminary opening of the label, than a conventional label attachment device that inserts a bottle into a label, then once lifts the bottle to remove expansion claws from the label, and then causes the bottle to fall, and therefore cannot execute a series of processes in which the clamp members receive a new label and preliminarily open the new label until the attachment target object moves to below the clamp members. This makes it possible to achieve the effect of facilitating the speeding up of a device.

Further, when, after the attachment target object has been inserted into the label, the pull-up unit pulls up the attachment target object, thereby removing the expansion claws from the label, as in the label attachment device according to the invention of claim 2, the mounting on which the attachment target object is mounted may be temporarily lifted in conjunction with an operation of the pull-up unit pulling up the attachment target object. Alternatively, as in the label attachment device according to the invention of claim 3, the expansion claws may once fall while the mounting on which the attachment target object is mounted is temporarily lifted in conjunction with an operation of the pull-up unit pulling up the attachment target object. Yet alternatively, as in the label attachment device according to the invention of claim 4, the expansion claws may once fall with the pull-up unit holding the attachment target object at the label portion, thereby removing the expansion claws from the label, and then, the pull-up unit may pull up the attachment target object. Thus, when the expansion claws are removed from the label, the full weight of the attachment target object is not applied to the pull-up unit. Moreover, when the expansion claws are removed from the label, the force of pulling down the attachment target object by the frictional force generated between the expansion claws and the attachment target object is not applied to the pull-up unit. Thus, when the expansion claws are removed from the label, the position of the pull-up unit holding the attachment target object at the label portion is unlikely to shift relative to the attachment target object. This results in achieving the effect that when the expansion claws are removed from the label, the position of the label attached to the attachment target object is unlikely to shift relative to the attachment target object.

In particular, as in the label attachment device according to the invention of claim 2, the mounting on which the attachment target object is mounted may be temporarily lifted in conjunction with an operation of the pull-up unit pulling up the attachment target object. Alternatively, as in the label attachment device according to the invention of claim 3, the expansion claws may once fall while the mounting on which the attachment target object is mounted is temporarily lifted in conjunction with an operation of the pull-up unit pulling up the attachment target object. This makes it possible to simultaneously perform the operation of removing the expansion claws and the operation of raising the attachment target object to which the label is attached. This makes it possible to move the attachment target object to which the label is attached in the shortest time without wasted waiting time.

Further, also in the label attachment device according to the invention of claims 2 to 4, after the expansion claws have been removed from the label, the pull-up unit pulls up the attachment target object, thereby moving the attachment target object to above the label opening unit, so that, while a process after the label opening unit receives the label is executed, the attachment target object to which the label is attached is conveyed above the label opening unit. This makes it possible to achieve an effect similar to that of the label attachment device according to the invention of claim 1.

DESCRIPTION OF EMBODIMENTS

Figure 1:
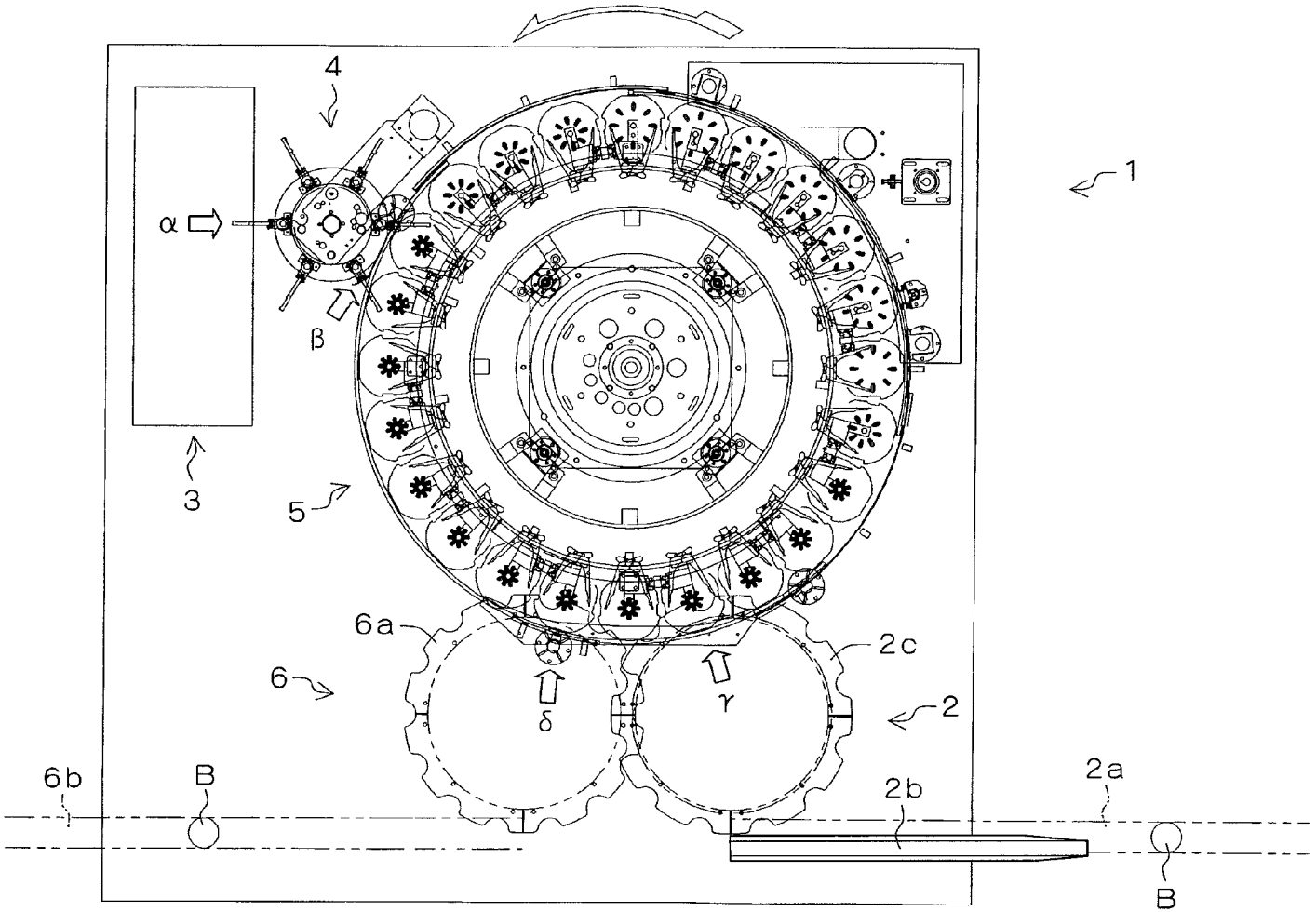
FIG. 1 is a schematic plan view of a label attachment system including an embodiment of a label attachment device according to the invention.

With reference to the drawings, embodiments are described below. FIG. 1 shows a label attachment system 1 for attaching a tubular stretch label (hereinafter referred to as a "label"), formed of an elastic and stretchable film made of a polyethylene resin, to a PET bottle (hereinafter referred to as a "bottle") B. The label attachment system 1 includes: a bottle supply device 2, which includes a belt conveyor 2*a*, a screw 2*b*, and a star wheel 2*c*; a label supply device 3, which forms labels by sequentially cutting an elongated label forming base material fed from a base material roll by a base material feeding section, and sequentially supplies the labels to a first label delivery position α; a label delivery device 4, which receives the labels supplied to the first label delivery position α by the label supply device 3, and conveys the labels to a second label delivery position β; a rotary label attachment device 5, which receives at a bottle supply position γ the bottle B supplied from the bottle supply device 2 and conveys the bottle B to a bottle sending position δ, and which also receives at the second label delivery position β a label conveyed by the label delivery device 4 and attaches the label to the bottle B while conveying the bottle B from the bottle supply position γ to the bottle sending position δ; and a bottle carrying-out device 6, which includes a star wheel 6*a* and a belt conveyor 6*b*, which carry out the bottle B to which the label has been attached by the label attachment device 5. The bottle carrying-out line of the bottle carrying-out device 6 is set at a position higher than the bottle supply line of the bottle supply device 2.

It should be noted that the label forming base material is a material in which tubular labels to be attached to the bottle B are continuously connected to each other, and is wound around a drum while being folded in a sheet at the base material feeding section.

Figure 2:
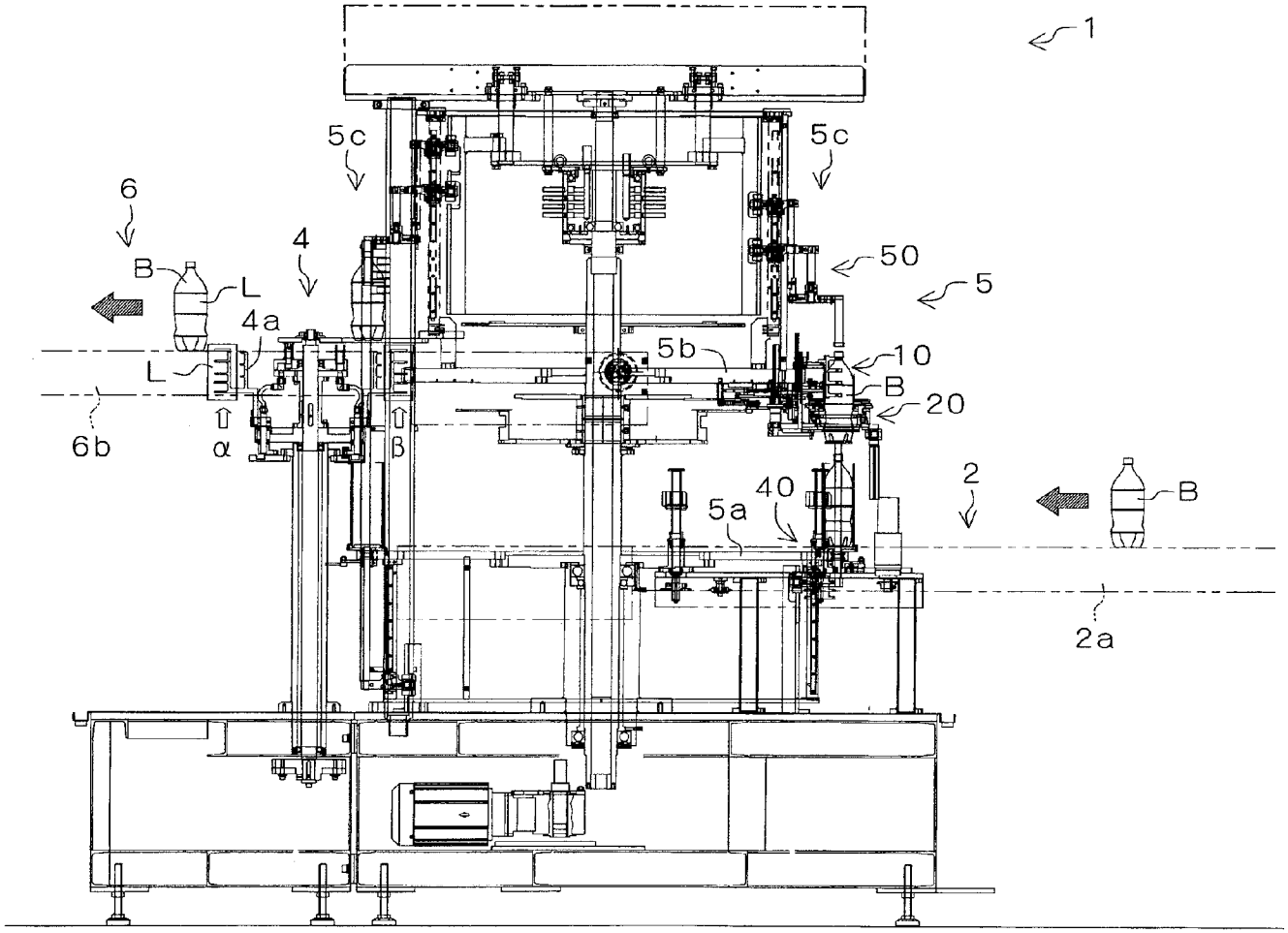
FIG. 2 is a schematic side view of the label attachment device.

As shown in FIGS. 1 and 2, the label attachment device 5 includes many label attachment heads 5*c* attached in a concentric circle about a rotating shaft (not shown) at regular intervals, via a supporting disk 5*a* attached to the rotating shaft and a plurality of supporting arms 5*b*, 5*b* projecting from the rotating shaft. Each label attachment head 5*c* expands a tubular label L folded in a sheet and received at the second label delivery position β, more widely than the outer diameter of the bottle B. Then, the expanded label L becomes attached to a main body portion of the bottle B while the bottle B received at the bottle supply position γ is being conveyed to the bottle sending position δ.

Figure 3:
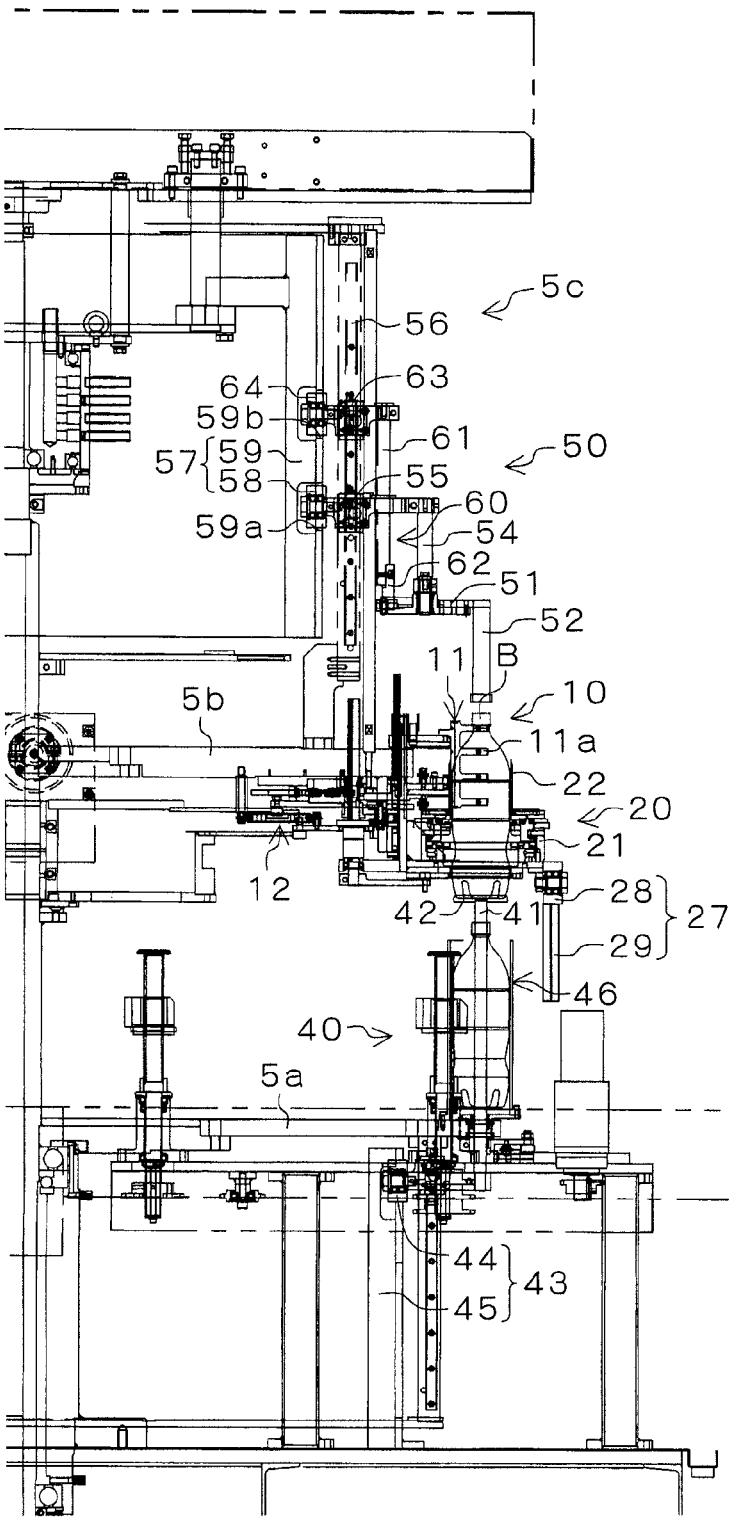
FIG. 3 is a schematic view of one of label attachment heads of the label attachment device.

As shown in FIG. 3, the label attachment head 5*c* includes: a label opening unit 10, which preliminarily opens the tubular label L folded in a sheet and received at the second label delivery position β; a label expansion unit 20, which expands the label L preliminarily opened by the label opening unit 10, more widely than the outer diameter of the bottle B; a bottle lifting unit 40, which raises a mounting 42 to insert the bottle B, mounted on the mounting 42 at a position below a label attachment level at the bottle supply position γ, into the label L expanded at the label attachment level; and a bottle pull-up unit 50, which lifts the bottle B while holding with the bottle B an upper end portion of the label attached to the bottle B.

As shown in FIG. 3, the label opening unit 10 includes: a pair of openable and closable clamp members 11; a suction unit (not shown), which performs suction through suction openings formed in clamping portions 11*a* of the clamp members 11, thereby causing the clamp members 11 to hold by suction both sides of the label L clamped by the clamp members 11; and an opening and closing driving unit 12, which opens and closes the clamp members 11. In the label opening unit 10, after one of the clamp members 11 has held by suction and received at the second label delivery position β the label L folded in a sheet and conveyed by the label delivery device 4, the pair of clamp members 11 clamp the label L, and the suction unit operates to cause the clamping portions 11*a* to hold by suction both sides of the label L. In this state, the clamp members 11 open to separate both sides of the label L from each other, thereby opening the label L into a tubular shape.

It should be noted that as shown in FIGS. 1 and 2, in the label delivery device 4, a take-up member 4*a*, which rotates so as to pass through the first label delivery position α and the second label delivery position β, has at its extremity a comb-like label adhesion portion, which adheres one side of the sheet-like label L. The clamping portions 11*a* of the clamp members 11 sandwich the label L adhered by the label adhesion portion and separate the label L from the label adhesion portion. Consequently, the label L is delivered.

Figure 4:
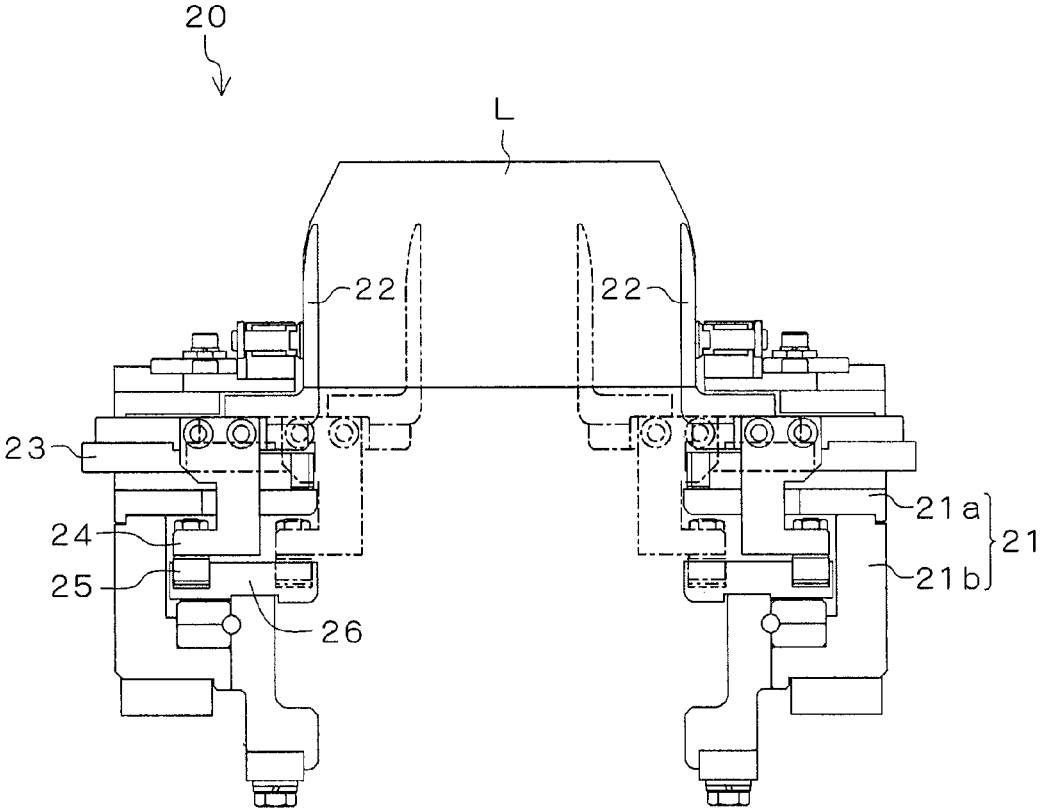
FIG. 4 is a cross-sectional view of a label expansion unit included in the label attachment device.

As shown in FIG. 4, the label expansion unit 20 includes: a base member 21, which includes an upper annular disk 21*a* and a lower tubular member 21*b* attached to a lower end portion of the upper annular disk 21*a*; eight expansion claws 22, which are supported by the annular disk 21*a* so as to be radially movable via sliding members 23; cam followers 25, which are attached to the respective sliding members 23 via supporting members 24; and an annular cam member 26, which is rotatably supported by an inner circular portion of the lower tubular member 21*b*, and to which the cam followers 25 fit, and in which a plurality of radial cam grooves extending circumferentially from the inner diameter to the outer diameter of the annular cam member 26 are formed. The cam member 26 is rotated by a cam mechanism (not shown), thereby causing the expansion claw 22 to radially advance or retreat.

As shown in FIG. 3, the label expansion unit 20 is supported so as to rise and fall by a supporting pillar attached to the supporting arm 5*b*. The label expansion unit 20 rises and falls by a rise and fall mechanism 27, which includes: a cam follower 28 attached to the lower tubular member 21*b* of the base member 21; and a cam member 29 having a cam surface that the cam follower 28 abuts.

Figure 5:
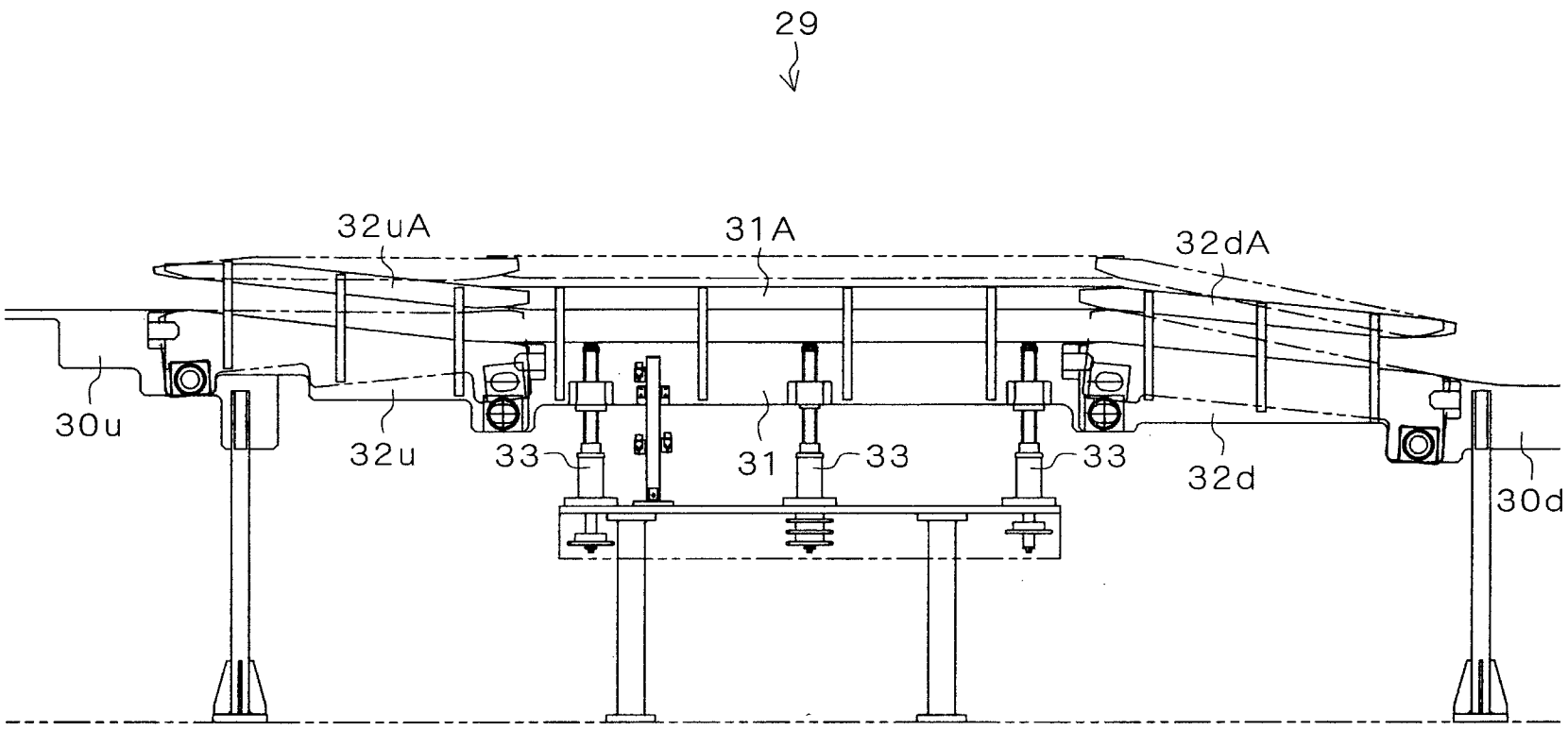
FIG. 5 is a side view of a cam member included in a rise and fall mechanism that causes the label expansion unit to rise and fall.

The cam member 29 is disposed along the movement path of the label expansion unit 20. As shown in FIG. 5, the cam member 29 includes: fixed portions 30*u* and 30*d*, of which the height positions cannot be changed; a rise and fall portion 31, of which the height position can be changed by a rise and fall mechanism 33; and connection portions 32*u* and 32*d*, which connect the fixed portions 30*u* and 30*d* and the rise and fall portion 31 so as to swing by following the rising and falling motion of the rise and fall portion 31.

The rise and fall portion 31 generally corresponds to the area between the position where the insertion of the bottle B into the label L expanded by the label expansion unit 20 starts (the position immediately after the bottle lifting unit 40 starts lifting the bottle B) and the position where the insertion of the bottle B is completed. The rise and fall portion 31 has a flat cam surface over the entire length. Thus, while the cam follower 28 is moving on the cam surface of the rise and fall portion 31, the expansion claws 22 of the label expansion unit 20 are maintained at the same height position.

The connection portion 32*u* corresponds to the area between the bottle supply position γ and the position where the insertion of the bottle B into the expanded label L starts (the position immediately after the bottle lifting unit 40 starts lifting the bottle B). The connection portion 32*d* corresponds to the area between the position where the insertion of the bottle B into the expanded label L is completed and the position immediately after the bottle pull-up unit 50 starts pulling up the bottle B. The rise and fall portion 31 rises and falls, thereby changing the angle of inclination of the cam surface at the connection portions 32*u* and 32*d*.

The area from the fixed portion 30*d* to the fixed portion 30*u* in the cam member 29 has only a cam surface that the lower surface of the cam follower 28 abuts. In the area from the fixed portion 30*u* to the fixed portion 30*d*, that is, the areas corresponding to the connection portion 32*u*, the rise and fall portion 31, and the connection portion 32*d*, on the upper sides of the connection portion 32*u*, the rise and fall portion 31, and the connection portion 32*d*, a connection portion 32*u*A, a rise and fall portion 31A, and a connection portion 32*d*A connected to the connection portion 32*u*, the rise and fall portion 31, and the connection portion 32*d*, respectively, are disposed at predetermined intervals. Thus, the cam follower 28 moves between: the connection portion 32*u*, the rise and fall portion 31, and the connection portion 32*d*; and the connection portion 32*u*A, the rise and fall portion 31A, and the connection portion 32*d*A.

Figure 6:
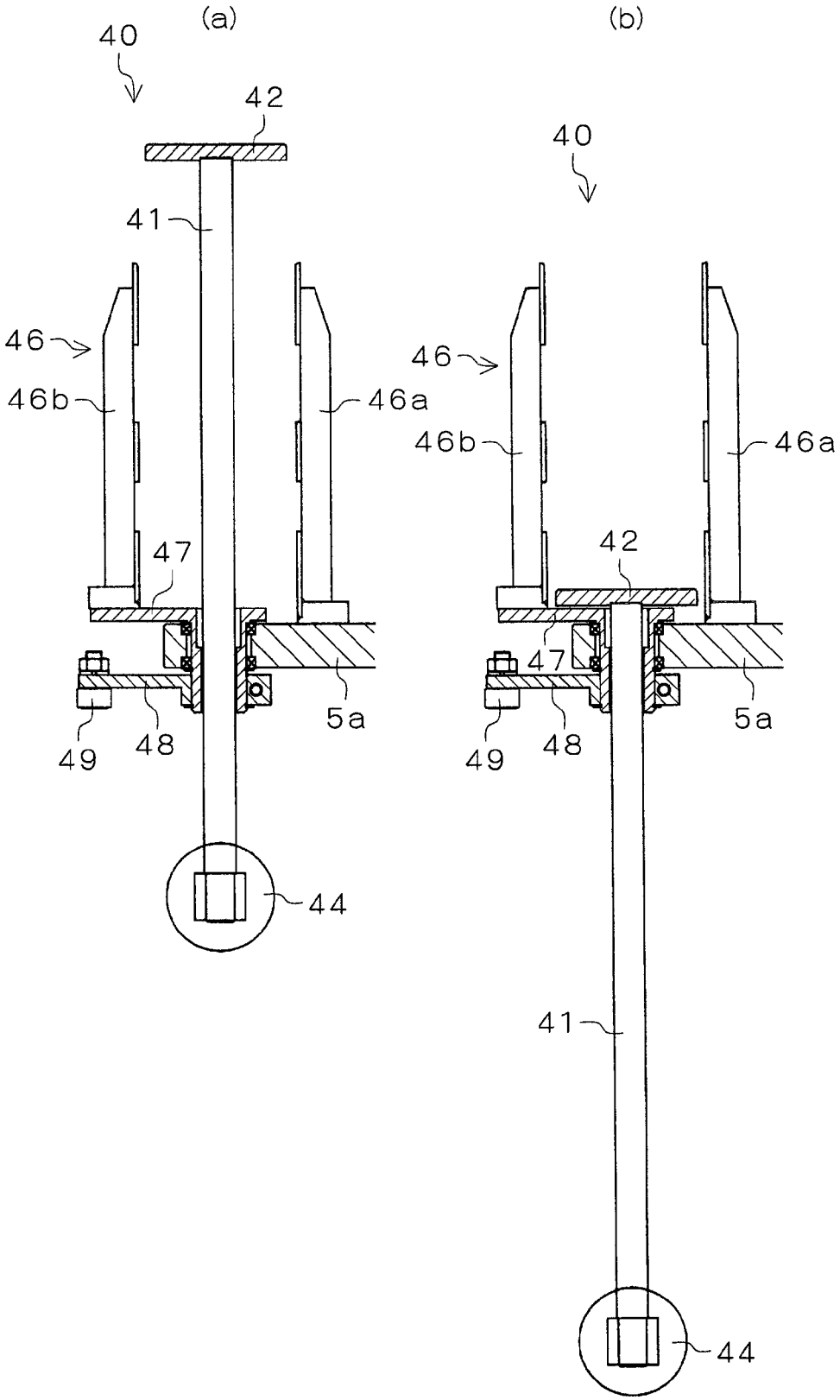
In FIG. 6, (a) is a cross-sectional view of the state where a mounting of a bottle lifting unit 40 included in the label attachment device has risen, and (b) is a cross-sectional view of the state where the mounting has fallen.

As shown in FIGS. 3 and 6, the bottle lifting unit 40 includes: an operation rod 41, which is supported so as to be movable up and down while penetrating a peripheral edge portion of the supporting disk 5*a* upward and downward; the mounting 42, on which the bottle B is mounted and which is attached to an upper end portion of the operation rod 41 on the upper side of the supporting disk 5*a*; and a rise and fall mechanism 43, which causes the operation rod 41 to rise and fall. The rise and fall mechanism 43 includes: a cam follower 44, which is attached to a lower end portion of the operation rod 41; and a cam plate 45, which has a cam groove into which the cam follower 44 fits.

Further, to prevent the bottle B mounted on the mounting 42 from falling over, an openable and closable bottle guide 46, which includes a fixed guide 46*a* and a movable guide 46*b* that surround the mounting 42, is disposed on the supporting disk 5*a*. Consequently, when the bottle B supplied from the bottle supply device 2 is received at the bottle supply position γ, the movable guide 46*b* opens so as not to hinder the reception of the bottle B.

The movable guide 46*b* is provided in a standing manner on a swinging lever 47 swingably supported by the supporting disk 5*a* via a bearing, with the operation rod 41 inserted so as to rise and fall. A cam follower 49, which is attached to a base end portion of the swinging lever 47 via a supporting member 48, abuts a cam surface of a cam member (not shown), thereby causing the swinging lever 47 to swing. Accordingly, the movable guide 46*b* opens and closes relative to the fixed guide 46*a*.

Figure 7:
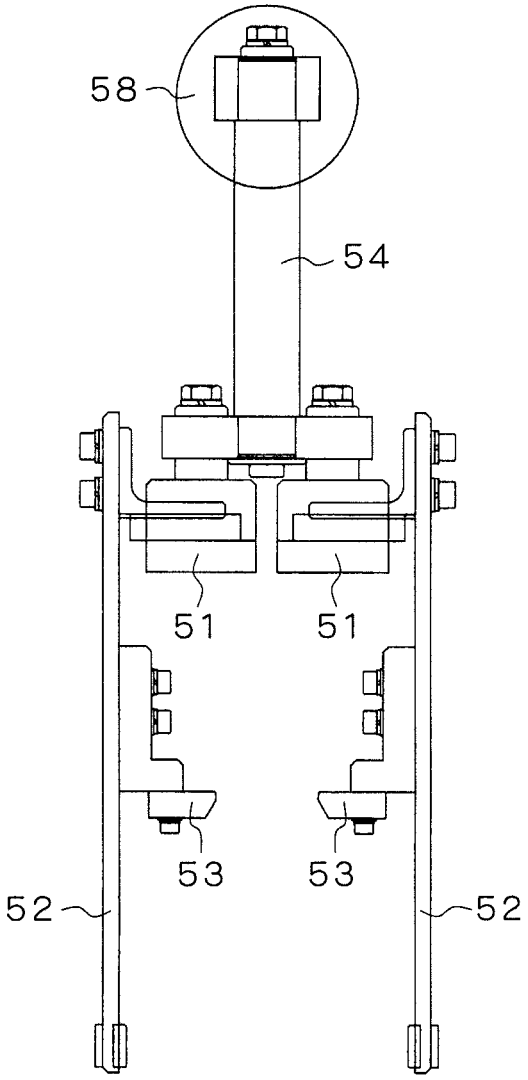
FIG. 7 is a schematic side view of a bottle pull-up unit 50 included in the label attachment device.

As shown in FIGS. 3 and 7, the bottle pull-up unit 50 includes: a pair of openable and closable swinging arms 51; a pair of left and right grippers 52, which are attached to extremity portions of the respective swinging arms 51 and hold an upper end portion of the label L on the main body portion of the bottle B on which the label L is attached; a pair of left and right neck clampers 53, which are attached to the respective grippers 52 and when the grippers 52 has held the bottle B, hold a neck portion of the bottle B; a rise and fall mechanism 57, which causes the swinging arms 51 to rise and fall; and an opening and closing mechanism 60, which opens and closes the swinging arms 51. The pair of left and right swinging arms 51 are supported so as to rise and fall by a slide rail 56 via a supporting member 54 and a slide guide 55, the slide rail 56 provided in a standing manner on the supporting arm 5*b*.

The rise and fall mechanism 57 includes: a cam follower 58, which is attached to the supporting member 54; and a cylindrical cam member 59, which has a cam groove 59*a* into which the cam follower 58 fits, the cam member 59 disposed along the movement paths of the grippers 52. A cam mechanism including the cam follower 58 and the cam member 59 (the cam groove 59*a*) moves up and down the slide guide 55, thereby causing the swinging arms 51 to rise and fall.

The opening and closing mechanism 60 includes: a spring (not shown), which always biases the swinging arms 51 in an opening direction; a pair of rollers (not shown), which are attached to the swinging arms 51 on the base end portion side; and an operation rod 61, to a lower end portion of which a cam member 62 is attached, the cam member 62 having a cam surface that abuts both rollers by being inserted between both rollers. The operation rod 61 is supported so as to be movable up and down by the supporting member 54, and a slide guide 63, which rises and falls along the slide rail 56, is attached to an upper end portion of the operation rod 61.

To the upper end portion of the operation rod 61, a cam follower 64, which fits into a cam groove 59*b* formed in the cam member 59, is attached. A cam mechanism including the cam follower 64 and the cam member 59 (the cam groove 59*b*) moves up and down the slide guide 63, thereby causing the operation rod 61 to rise and fall.

Thus, if the cam follower 64 has fallen using the cam groove 59*b*, then accordingly, the operation rod 61 falls, and the cam member 62 attached to the lower end portion of the operation rod 61 presses and spreads the rollers, thereby causing the swinging arms 51 to close on the extremity sides. Thus, the cam mechanism including the cam groove 59*b* and the cam follower 64 moves up and down the operation rod 61, thereby opening and closing the swinging arms 51.

In the label attachment device 5 configured as described above, first, as shown in FIGS. 1 and 2, the clamp members 11 receive the tubular label L folded in a sheet and conveyed to the label delivery position β by the label delivery device 4. At the second label delivery position β, after, as shown in (a) of FIG. 8, one of the clamp members 11 has received the label L, conveyed by the take-up member 4*a* of the label delivery device 4, by holding by suction one side of the label L, then as shown in (b) of FIG. 8, the pair of clamp members 11 clamp the label L. Then, with the clamping portions 11*a* holding by suction both sides of the label L, as shown in (c) and (d) of FIG. 8, the clamp members 11 open to separate both sides of the label L from each other, thereby opening the label L into a tubular shape.

Figure 8:
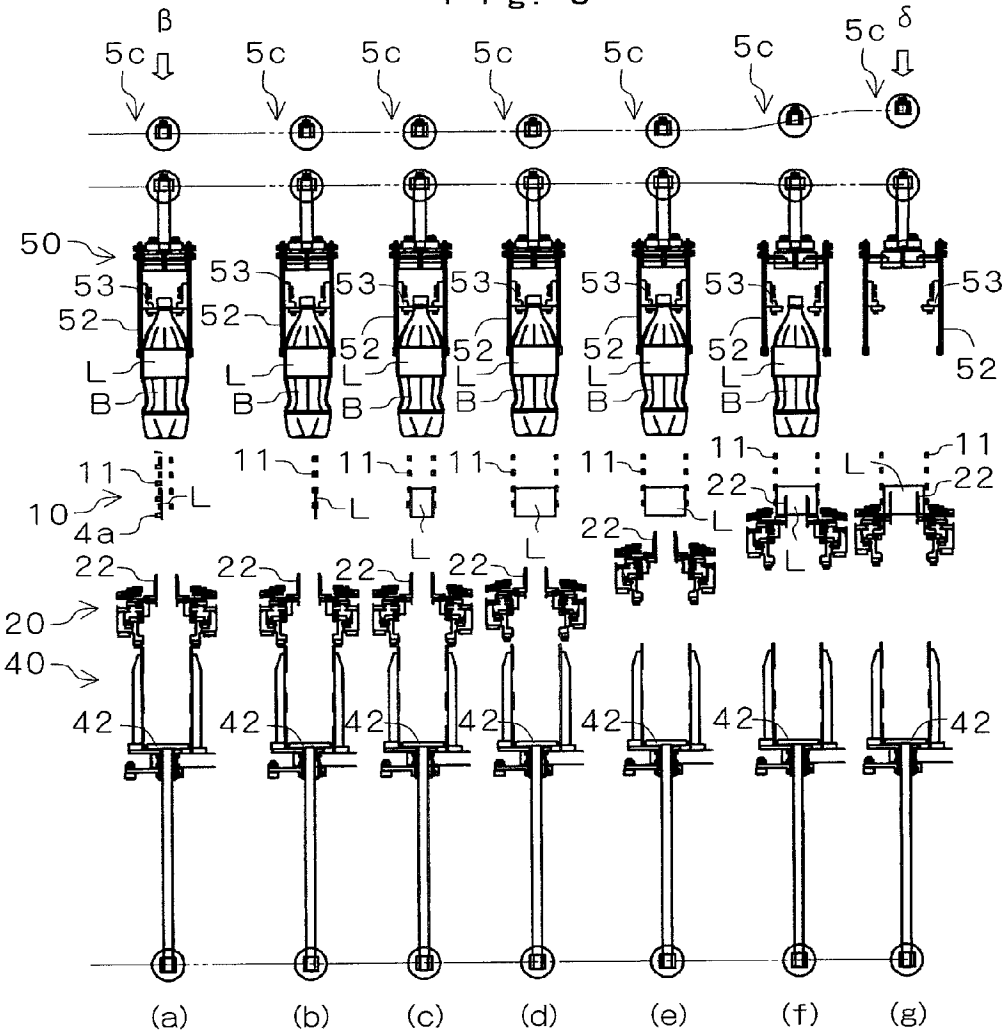
In FIG. 8, (a) to (g) are an operation illustration of a label attachment operation of the label attachment device.

Subsequently, as shown in (e) and (f) of FIG. 8, the expansion claws 22 in a closed state gradually rise and are inserted into the label L that is in an open state and held by suction by the clamp members 11. Then, as shown in (f) and (g) of FIG. 8, the grippers 52 of the bottle pull-up unit 50 open to release the holding of the main body portion and the neck portion of the bottle B. Then, at the bottle sending position δ, the bottle B to which the label L is attached is delivered to the star wheel 6*a* of the bottle carrying-out device 6.

Figure 9:
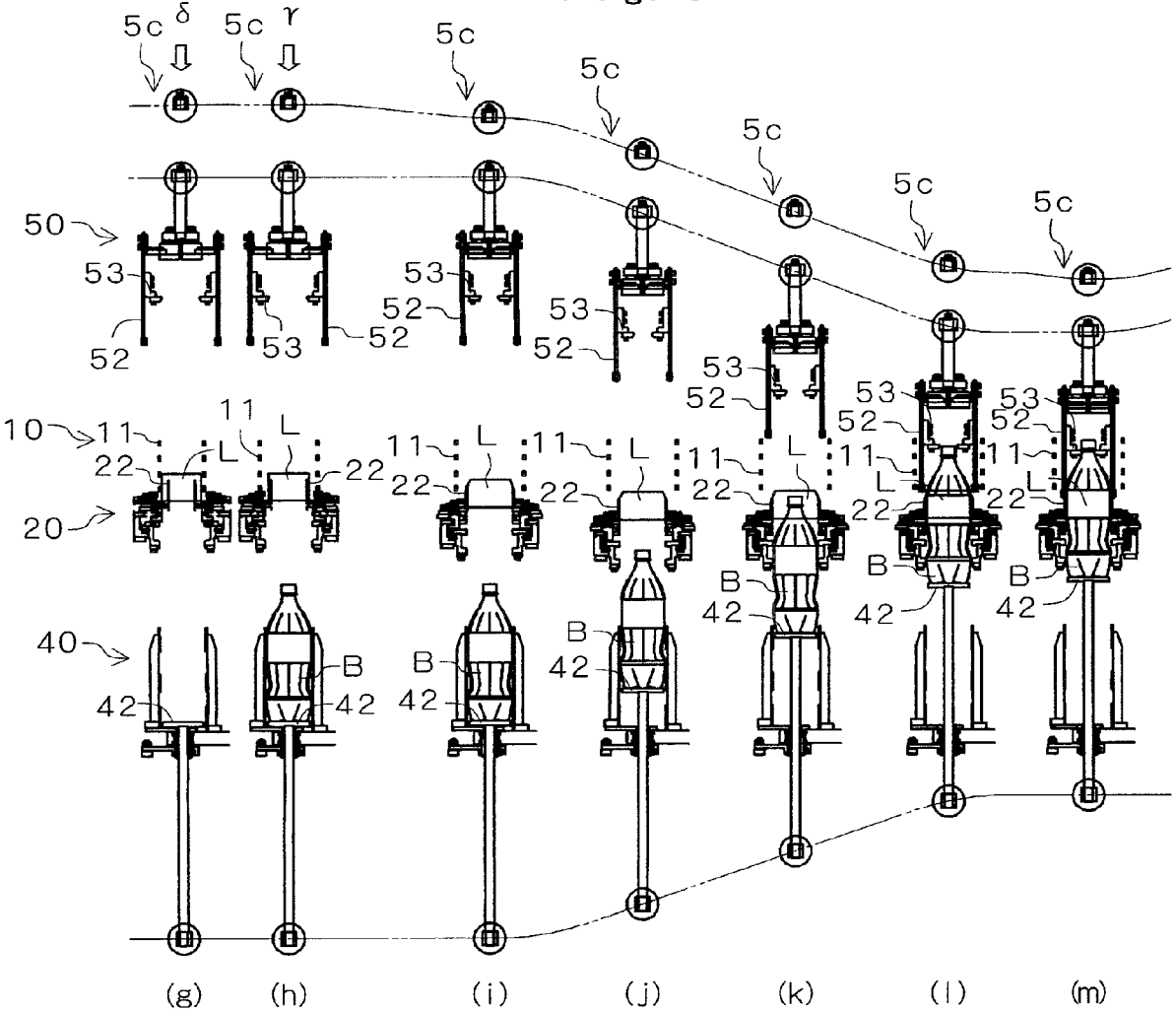
In FIG. 9, (g) to (m) are an operation illustration of the label attachment operation of the label attachment device.

If the expansion claws 22 in the closed state have thus been inserted into the label L in the open state (see (g) of FIG. 9), then as shown in (h) to (j) of FIG. 9, the expansion claws 22 that are in the closed state and inserted into the label L in the open state open, thereby expanding the label L while falling to the label attachment level. Meanwhile, at the bottle supply position γ, a new bottle B delivered from the bottle supply device 2 becomes mounted on the mounting 42 of the bottle lifting unit 40.

Subsequently, as shown in (j) to (m) of FIG. 9, the mounting 42 on which the bottle B is mounted rises, thereby inserting the bottle B into the expanded label L. Meanwhile, the grippers 52 of the bottle pull-up unit 50 fall, the pair of left and right grippers 52 hold the upper end portion of the label L on the main body portion of the bottle B on which the label L is attached, and the pair of left and right neck clampers 53 attached to the grippers 52 hold the neck portion of the bottle B.

Figure 10:
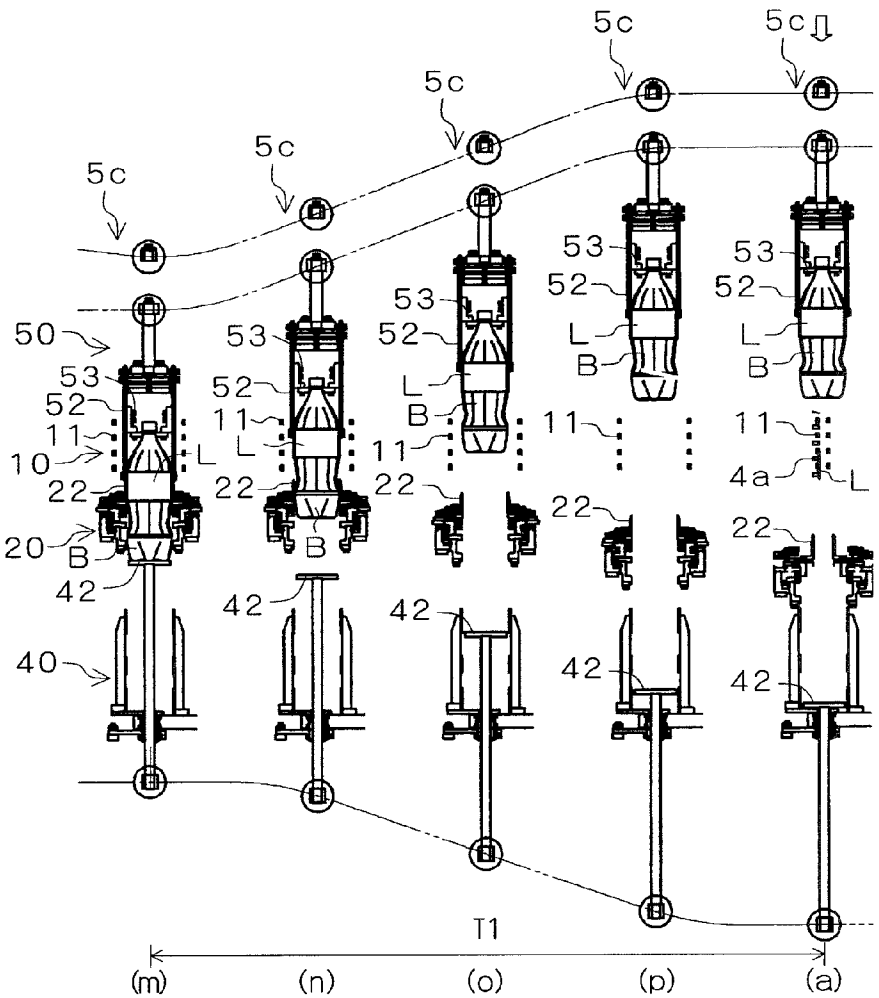
In FIG. 10, (m) to (a) are an operation illustration of the label attachment operation of the label attachment device.

If the bottle B has thus been inserted into the label L (see (m) of FIG. 10), then as shown in (n) of FIG. 10, the grippers 52 and the neck clampers 53 holding the main body portion and the neck portion of the bottle B rise, thereby pulling the expansion claws 22 out of the label L attached to the bottle B. Then, as shown in (o) and (p) of FIG. 10, the grippers 52 and the neck clampers 53 further rise, thereby moving the bottle B to above the clamp members 11. Meanwhile, the mounting 42 and the expansion claws 22 fall, whereby the process returns to an initial state shown in (a) of FIG. 10 ((a) of FIG. 8).

Figure 15:
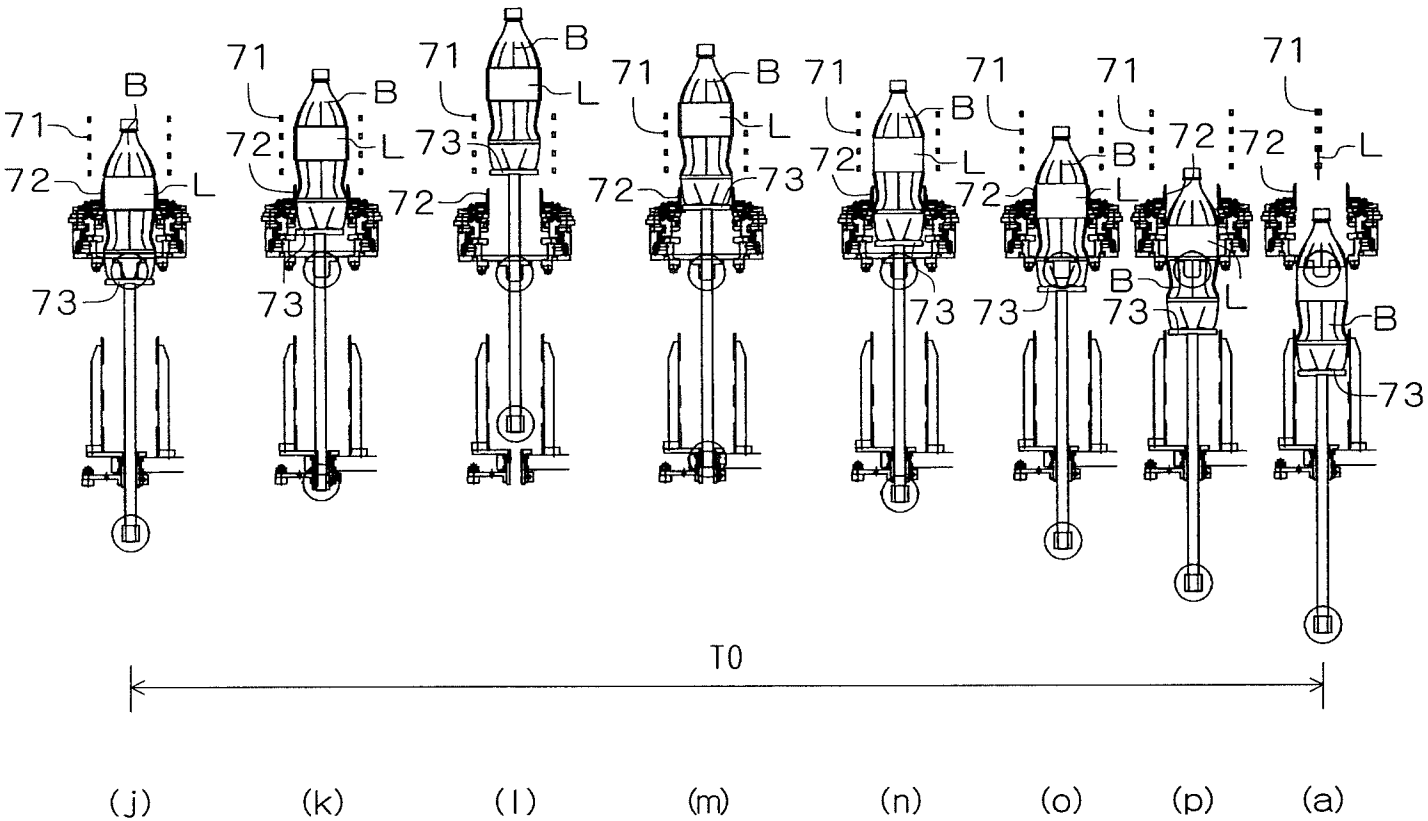
In FIG. 15, (j) to (a) are an operation illustration of the label attachment operation.

As described above, in the label attachment device 5, the bottle pull-up unit 50 is provided, which pulls up the bottle B to which the label L is attached, while holding the bottle B at the label L portion. After the bottle B has been inserted into the label L, the bottle pull-up unit 50 pulls up the bottle B, thereby removing the expansion claws 22 from the label L. Then, the bottle B is moved as it is to above the clamp members 11 of the label opening unit 10. This shortens the time required from when the label L is attached to the bottle B to when the clamp members 11 receive a new label L, that is, the time (T1) required for (m) to (a) of FIG. 10, to about 50% of the time required from when a label is attached to a bottle to when clamp members receive a new label, that is, the time (T0) required for (j) to (a) of FIG. 15, in a conventional label attachment device that inserts a bottle into a label, then once lifts the bottle to remove expansion claws from the label, and then causes the bottle to fall. This makes it possible to secure a more sufficient assigned angle for executing a series of processing steps from the reception of a label to the preliminary opening of the label, than the conventional label attachment device. This makes it possible to achieve the effect of facilitating the speeding up of a device.

Further, in the label attachment device 5, as shown in (h) to (m) of FIG. 9, when the bottle B is inserted into the tubular label L expanded by the expansion claws 22, the expansion claws 22 expanding the label L fall to the label attachment level while the mounting 42 on which the bottle B is mounted is lifted. This makes it possible to insert the bottle B into the label L in the shortest time, regardless of the label attachment level.

It should be noted that in the above embodiment, the bottle pull-up unit 50 pulls up the bottle B, thereby removing the expansion claws 22 from the label L. To remove the expansion claws 22 from the label L as described above, however, when the expansion claws 22 are removed from the label L, the full weight of the bottle B is applied to the bottle pull-up unit 50. Simultaneously, the force of pulling down the bottle B by the frictional force generated between the inner surfaces of the expansion claws 22 and the outer surface of the bottle B when the expansion claws 22 are removed from the label L is applied to the bottle pull-up unit 50. Thus, the position of the bottle pull-up unit 50 holding the bottle B at the label L portion may shift relative to the bottle B. As a result, when the expansion claws 22 are removed from the label L, the position of the label L attached to the bottle B may shift relative to the bottle B.

Figure 11:
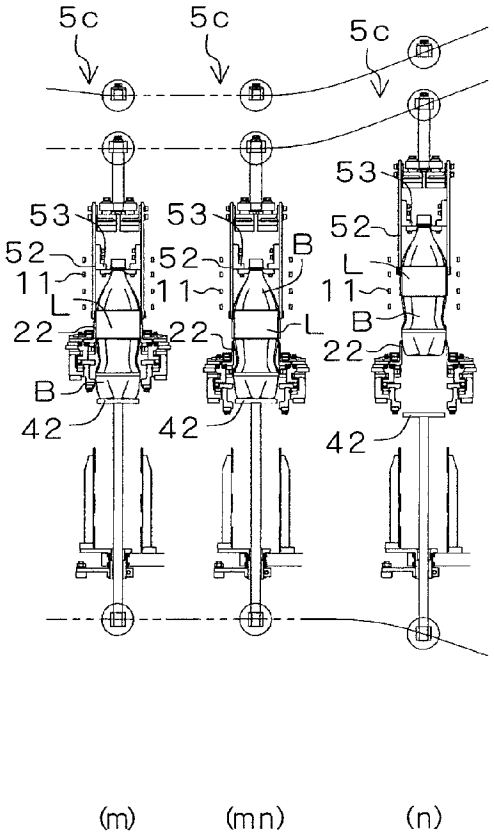
In FIG. 11, (m) to (n) are an operation illustration of a label attachment operation of a label attachment device according to another embodiment.

Thus, after, as shown in (m) of FIG. 11, the bottle B has been inserted into the label L, then as shown in (mn) of FIG. 11, with the bottle pull-up unit 50 holding at the label L portion the bottle B mounted on the mounting 42, the expansion claws 22 may once fall, thereby removing the expansion claws 22 from the label L. Then, as shown in (n) of FIG. 11, the bottle pull-up unit 50 may pull up the bottle B, thereby moving the bottle B to above the label opening unit 10. Consequently, when the expansion claws 22 are removed from the label L, the full weight of the bottle B is not applied to the bottle pull-up unit 50. Moreover, when the expansion claws 22 are removed from the label L, the force of pulling down the bottle B by the frictional force generated between the inner surfaces of the expansion claws 22 and the outer surface of the bottle B is not applied to the bottle pull-up unit 50. Thus, when the expansion claws 22 are removed from the label L, the position of the bottle pull-up unit 50 holding the bottle B at the label L portion is unlikely to shift relative to the bottle B. This results in achieving the effect that when the expansion claws 22 are removed from the label L, the position of the label L attached to the bottle B is unlikely to shift relative to the bottle B.

In this case, however, the time during which the expansion claws 22 are removed from the label L becomes waiting time. Thus, after, as shown in (m) of FIG. 12, the bottle B has been inserted into the label L, then as shown in (mn) of FIG. 12, the bottle pull-up unit 50 may pull up the bottle B while holding at the label L portion the bottle B mounted on the mounting 42. Simultaneously, in conjunction with the operation of the bottle pull-up unit 50 pulling up the bottle B, the mounting 42 on which the bottle B is mounted may be temporarily lifted to remove the expansion claws 22 from the label L while the bottle pull-up unit 50 continues the operation of pulling up the bottle B, thereby moving the bottle B to above the label opening unit 10. This makes it possible to simultaneously perform the operation of removing the expansion claws 22 and the operation of raising the bottle B to which the label L is attached. This can prevent the positional shift of the label L when the expansion claws 22 are removed from the label L. Moreover, this makes it possible to move the bottle B to which the label L is attached in the shortest time without wasted waiting time.

Figure 13:
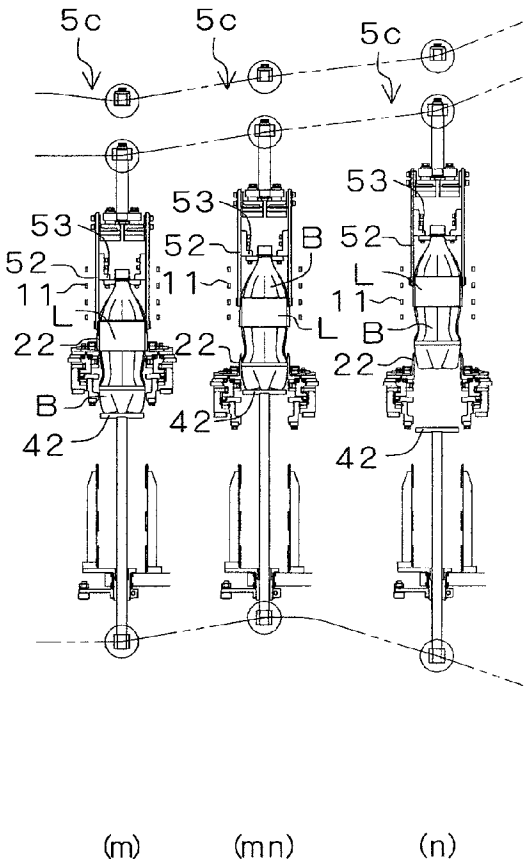
In FIG. 13, (m) to (n) are an operation illustration of a label attachment operation of a label attachment device according to another embodiment.
Figure 12:
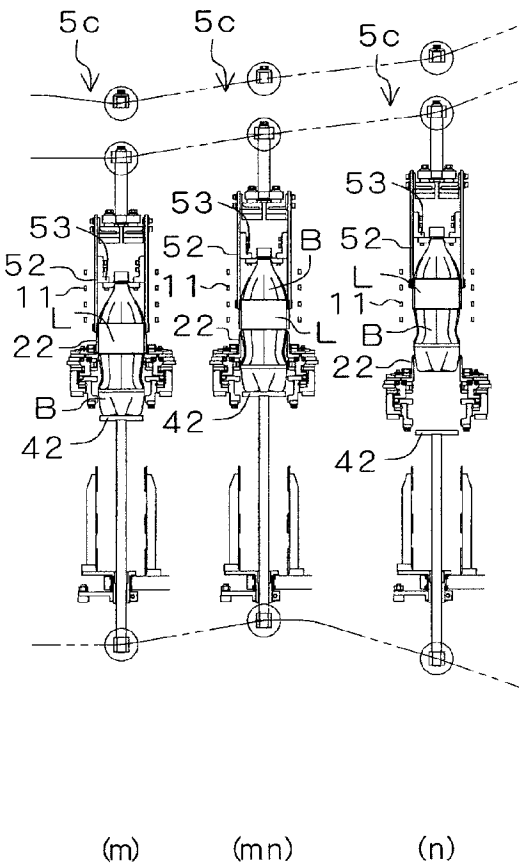
In FIG. 12, (m) to (n) are an operation illustration of a label attachment operation of a label attachment device according to another embodiment.
Figure 14:
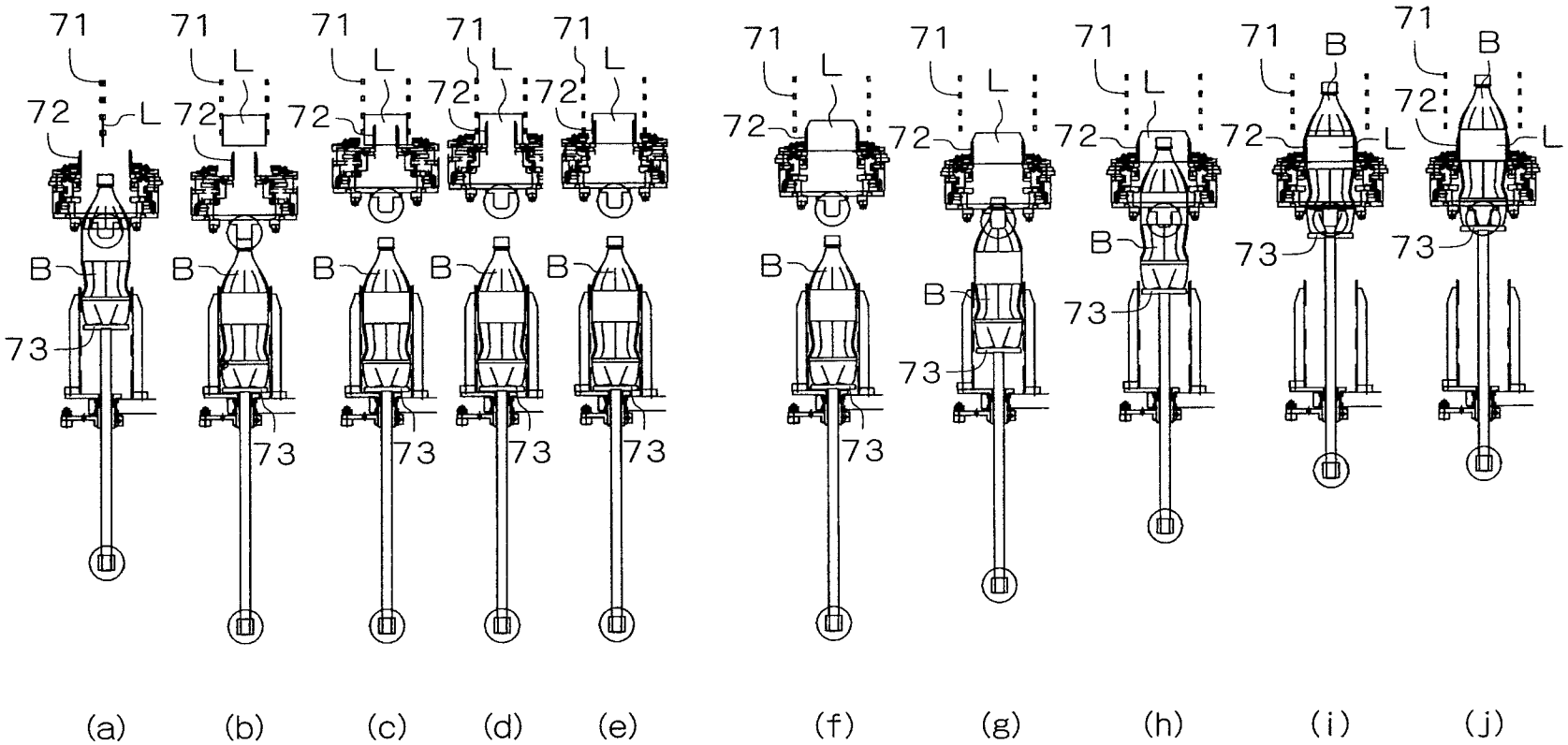
In FIG. 14, (a) to (j) are an operation illustration of a label attachment operation of a conventional label attachment device.

Further, after, as shown in (m) of FIG. 13, the bottle B has been inserted into the label L, then as shown in (mn) of FIG. 13, with the bottle pull-up unit 50 holding at the label L portion the bottle B mounted on the mounting 42, the bottle B may be pulled up. Simultaneously, the expansion claws 22 may once be caused to fall while the mounting 42 on which the bottle B is mounted is temporarily lifted in conjunction with the operation of the bottle pull-up unit 50 pulling up the bottle B. Thus, while the expansion claws 22 are removed from the label L, the bottle pull-up unit 50 can continue the operation of pulling up the bottle B, thereby moving the bottle B to above the label opening unit 10. Also in this case, similarly to the case where the mounting 42 on which the bottle B is mounted is temporarily lifted in conjunction with the operation of the bottle pull-up unit 50 pulling up the bottle B as shown in FIG. 12, it is possible to prevent the positional shift of the label L when the expansion claws 22 are removed from the label L. Moreover, it is possible to move the bottle B to which the label L is attached in the shortest time without wasted waiting time.

Further, in the above embodiments, the case is described where a stretch label is attached to a PET bottle. An attachment target object, however, is not limited to a PET bottle as described above. It goes without saying that alternatively, the label attachment device according to the present invention can be applied to the case where a stretch label is attached to various containers such as a jar and a can, and a tubular object.

INDUSTRIAL APPLICABILITY

The invention can be applied to a label attachment device that attaches a stretch label to an attachment target object such as a jar or a bottle.

DESCRIPTION OF THE REFERENCE CHARACTERS

1 label attachment system
2 bottle supply device
2*a* belt conveyor
2*b* screw
2*c* star wheel
3 label supply device
4 label delivery device
4*a* take-up member
5 label attachment device
5*a* supporting disk
5*b* supporting arm
5*c* label attachment head
6 bottle conveyance device
6*a* star wheel
6*b* belt conveyor
10 label opening unit
11 clamp member
11*a* clamping portion
12 opening and closing driving unit
20 label expansion unit
21 base member
21*a* upper annular disk
21*b* lower tubular member
22 expansion claw
23 sliding member
24 supporting member
25 cam follower
26 cam member
27 rise and fall mechanism
28 cam follower
29 cam member
30*u*, 30*d* fixed portion
31, 31A rise and fall portion
32*u*, 32*d*, 32*u*A, 32*d*A connection portion
33 rise and fall mechanism
40 bottle lifting unit
41 operation rod
42 mounting
43 rise and fall mechanism
44 cam follower
45 cam plate
46 bottle guide
46*a* fixed guide
46*b* movable guide
47 swinging lever
48 supporting member
49 cam follower
50 bottle pull-up unit
51 swinging arm
52 gripper
53 neck clamper
54 supporting member
55 slide guide
56 slide rail
57 rise and fall mechanism
58 cam follower
59 cam plate
59*a*, 59*b* cam groove
60 opening and closing mechanism
61 operation rod
62 cam member
63 slide guide
64 cam follower
B bottle
L stretch label

The invention claimed is:

1. A label attachment device comprising:

a label opening unit configured to preliminarily open a tubular label supplied as folded in a sheet;

a label expansion unit having openable and closable expansion claws configured to expand the label preliminarily opened by the label opening unit;

a lifting unit configured to:

lift a mounting on which an attachment target object is mounted to a label attachment level, and insert the attachment target object into the tubular label expanded by the expansion claws, the expansion claws being removed from the label after the attachment target object is inserted into the tubular label, thereby attaching the label to the attachment target object that is moving along a predetermined movement path; and a pull-up unit configured to pull up the attachment target object to which the label is attached, while holding the attachment target object at a label portion, wherein the expansion claws are removed from the label after the attachment target object has been inserted into the label by: (i) the pull-up unit being configured to pull up the attachment target object, and/or (ii) the expansion claws being configured to fall while the pull-up unit is configured to hold the attachment target object at the label portion, and the pull-up unit is configured to pull up the attachment target object after the attachment target object has been inserted into the label, thereby moving the attachment target object above the label opening unit such that the attachment target object to which the label is attached is conveyed above the label opening unit and a process after the label opening unit receives the label is executed.

2. The label attachment device according to claim 1, wherein the pull-up unit is configured to pull the attachment target object, when the expansion claws are removed from the label, thereby temporarily lifting the mounting on which the attachment target object is mounted, in conjunction with an operation of the pull-up unit pulling up the attachment target object.

3. The label attachment device according to claim 1, wherein the pull-up unit configured to pull the attachment target object, when the expansion claws are removed from the label, thereby causing the expansion claws to once fall while temporarily lifting the mounting on which the attachment target object is mounted, in conjunction with an operation of the pull-up unit pulling up the attachment target object.

4. The label attachment device according to claim 1, wherein after the attachment target object has been inserted into the label, the expansion claws are configured to once fall with the pull-up unit holding the attachment target object at the label portion, thereby removing the expansion claws from the label.

* * * * *